US007748081B2

(12) United States Patent
Ganter

(10) Patent No.: US 7,748,081 B2
(45) Date of Patent: Jul. 6, 2010

(54) ADJUSTABLE HINGE

(75) Inventor: Bernhard Ganter, Furtwangen (DE)

(73) Assignee: Otto Ganter GmbH & Co. KG - Normteilefabrik, Furtwangen (DE)

( * ) Notice: Subject to any disclaimer, the term of this patent is extended or adjusted under 35 U.S.C. 154(b) by 912 days.

(21) Appl. No.: 11/512,423

(22) Filed: Aug. 30, 2006

(65) Prior Publication Data

US 2007/0056143 A1 Mar. 15, 2007

(30) Foreign Application Priority Data

Aug. 30, 2005 (DE) ..... 10 2005 041 132

(51) Int. Cl.
*E05D 7/04* (2006.01)

(52) U.S. Cl. ..... 16/235; 16/240; 16/236; 16/385; 16/387

(58) Field of Classification Search ..... 16/235–237, 16/238, 239, 240–242, 245, 246, 247, 385, 16/387; 411/160–162, 187, 188
See application file for complete search history.

(56) References Cited

U.S. PATENT DOCUMENTS 1,002,394 A * 9/1911 Hanson ..... 16/240
1,044,055 A * 11/1912 Johnson et al. ..... 403/107
2,248,372 A * 7/1941 May ..... 16/240
2,271,732 A * 2/1942 Chappuis ..... 411/158
2,980,453 A * 4/1961 Nesson ..... 403/281
3,006,443 A * 10/1961 Siler ..... 403/408.1
4,614,452 A * 9/1986 Wang ..... 403/27
5,011,351 A * 4/1991 Terry ..... 411/144
5,356,253 A * 10/1994 Whitesell ..... 411/188
5,621,943 A * 4/1997 Berge et al. ..... 15/250.34
6,286,185 B1 * 9/2001 Ramsauer ..... 16/236
6,725,504 B1 * 4/2004 Dickson et al. ..... 16/236

* cited by examiner

*Primary Examiner*—Chuck Y. Mah
(74) *Attorney, Agent, or Firm*—Browdy and Neimark, PLLC

(57) ABSTRACT

The invention has as its object an adjustable hinge, comprising at least one pivotable hinge plate provided with at least one through-opening, and comprising at least one alignment washer provided with at least one through-opening, which through-openings are provided for penetration by assembly means for mounting the hinge, wherein the alignment washer and hinge plate are adjustable relative to each other in the plane of the hinge plate, and wherein the alignment washer and/or hinge plate is provided with at least one protruding sharp-edged annular collar and/or a multitude of pointed raised areas having a higher degree of hardness than the mating surfaces contacting it of the other component cooperating with it, namely the alignment washer or the hinge plate. The advantage is that the alignment washer can be adjusted as desired, i.e., also rotated, relative to the hinge plate, and fixed in form-fitting engagement.

16 Claims, 3 Drawing Sheets

A (2 : 1)

ADJUSTABLE HINGE

Figure 1:
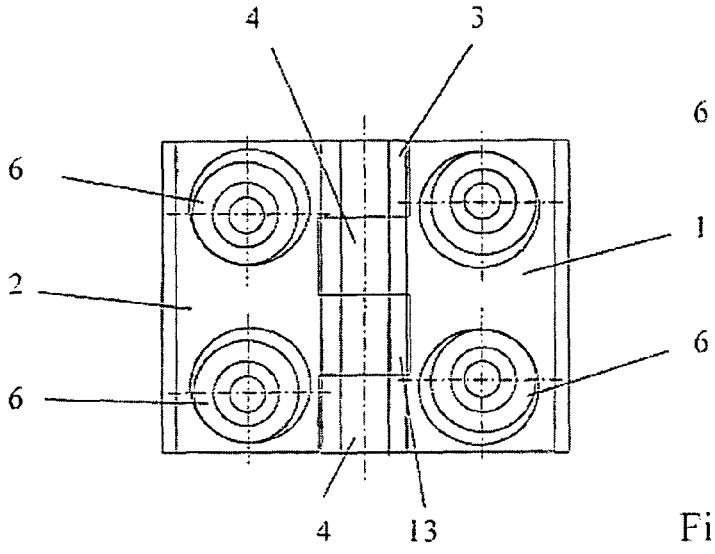

The invention has as its object an adjustable hinge according to the precharacterizing portion of claim 1.

A hinge of this type has become known, for example, with the subject matter of EP 0 991 836 B1. In this known hinge the adjustment in two directions perpendicular to each other consists of the hinge plate in each case having arranged in it a recessed slotted hole, the surrounding region of which is provided with a fluting.

Engaging into this slotted-hole-like cavity is an alignment bushing consisting of a larger-diameter washer-shaped top part, on whose underside an integral smaller-diameter oval collar is provided. This oval collar engages into the corresponding oval receptacle in the hinge plate and also has a fluting on its underside.

The fluting on the underside of the alignment washer consequently cooperates with the fluting in the recessed slotted hole in the hinge plate.

To adjust the hinge, the alignment washer can thus be displaced inside the slotted hole in two directions perpendicular to each other, in order to then be fixed with a screw extending through the alignment washer.

This is a proven design, however it is relatively expensive because of the detailed molds for the die-cast part.

An additional shortcoming is that the fluting at the bottom of the slotted-hole-shaped receptacle in the hinge plate and the fluting on the face of the alignment washer have the same orientation.

The result is that one alignment washer can be displaced in the slotted-hole-shaped cavity only in one direction and the adjacent alignment washer can be displaced in the other slotted-hole-shaped formation in the direction perpendicular to the former. It is consequently only possible to adjust the alignment washer in the respective slotted-hole-shaped cavity in one single direction. The range of adjustment is therefore limited.

An additional embodiment of a hinge by firm EMKA has become known, wherein the hinge plate of the hinge has round cavities provided in it, at the bottom of which a flange is formed with a smaller-diameter fluting.

The flutings disposed at the bottom of the receptacle are arranged offset relative to each other by an angle of 90°. This means there exists only the alignment in one direction and in a direction perpendicular to the same.

The corresponding alignment washers are designed circular ring shaped and have a round collar, on whose lower face flutings are again provided. These flutings, too, are formed offset relative to each other by an angle of 90°.

This has the result that, when the hinge is adjusted when the mounting screw is not screwed in, the alignment washer must thus be turned inside the receiving bore of the hinge plate in such a way that the flutings of the alignment washer and of the receiving bore in the hinge plate have the same orientation. This means that only four different relative positions of the alignment washer inside the receiving bore of the hinge plate are possible, which are offset from each other by 90° in each case.

This means that the alignment washer can be displaced inside the round cavity of the hinge plate only in the longitudinal direction and/or in the direction perpendicular thereto, and fixed in accordance with the division of the fluting.

This requires that the perpendicularly oriented flutings on the bottom of the alignment washer and at the bottom of the receptacle engage into each other in a form-fitting manner.

A form-fitting engagement of this kind is always aspired to, as it is necessary, due to the total weight of the door and when the mounting screw is unscrewed, that the alignment washer still engages into the fluting in a form-fitting manner, to prevent the door along with the connected hinge from accidentally moving out of position on the frame.

A form-fitting engagement of this type can thus be achieved in each case only in directions that are offset from each other by 90° with respect to the alignment washer and the engagement inside the round hole of the hinge plate.

The circular design of the alignment washer, however, has the shortcoming in the EMKA design that it can rotate by less than 90° prior to or during tightening of the mounting screw, and the flutings of the alignment washer and of the receiving bore of the hinge plate can no longer engage into each other in a form-fitting manner.

In the case of EP 0 991 836 B1, an adjustment could thus be made in the corresponding slotted hole only in one single direction, in the EMKA design the alignment washer could be adjusted and secured in the round hole of the hinge plate in two directions perpendicular to each other.

The invention is therefore based on the object of improving a hinge with alignment washers of the type mentioned at the beginning, in such a way that the installation can be performed faster, simpler, more reliably, and reproducible many times over, and the alignment washer can be adjusted in the process in all directions within the plane of the hinge plate as desired, and fixed in a form-fitting manner.

To meet the above object, the invention is characterized by the technical teaching of claim 1.

It is an essential feature of the invention that the at least one sharp-edged raised area that is provided on the alignment washer and/or on the hinge plate has a higher degree of hardness than at least the mating surfaces contacting it of the other component cooperating with it, namely the alignment washer or hinge plate.

This has the advantage that the at least one sharp-edged raised area, because of its higher degree of hardness, digs into the softer counterpart in a form-fitting manner and thus creates an impressed annular groove in that area as the hinge screw is tightened, the alignment washer being adjustable relative to the hinge plate in all directions virtually as desired within the plane of the hinge plate, and a fast, simple, reliable, repeatedly reproducible assembly can thus be performed.

The at least one raised area of greater hardness is preferably implemented in the form of a sharp-edged annular collar that is closed in itself, or also by a multitude of identical or similar pointed raised areas (e.g., pyramids), which together form a regularly or irregularly interrupted ring (circle, ellipse, etc.).

Alternatively, these pointed raised areas may also be distributed over a larger surface and take the form of a "gripper surface" with a multitude of matrix-like adjoining pyramids, or also with a multitude of ribs, for example, with triangular cross-section.

Additionally, the soft mating surface, into which the at least on pointed raised area penetrates in a form-fitting manner does not necessarily need to be formed plane and level, but it may also have at least one raised area, or at least one area that is recessed from the surface of the mating surface. This at least one raised area or this at least one recessed area may have any desired shape in cross section, e.g., it may be triangular, square, polygonal, trapezoid, circular, etc., and it may also exist in plurality. Preferred is a multitude of ribs in a radial arrangement with triangular cross section raised above the soft mating surface.

The relatively hard raised areas are provided especially on the alignment washer and they are pushed into the softer material of the bottom of the receptacle of the hinge plate purely through the force of tightening the hinge screw, causing corresponding indentations to be impressed in that region, which create a form-fitting engagement with the raised areas. However, the precondition for this is that at least the bottom of the receptacle of the hinge plate (or only the receptacle, or the entire hinge plate) is composed of a softer material than the raised areas of the alignment washer. In particular, the entire alignment washer is composed of steel and the entire hinge plate of die-cast zinc.

To attain an improvement of the form-fitting engagement via the impression of the raised areas of the alignment washer, two design variants are provided in particular:

1. The annular collar is implemented in such a way that it consists of a circle of "points", which now dig into the softer counterpart (e.g., die-cast zinc part) more easily. Of course, one can also abandon an annular collar (or plurality of them) altogether and, for example, provide the alignment washer with a so-called "gripper surface", namely with pyramid-shaped points. This is no longer purely a cost-effective turned part, however.

2. E.g., the alignment washer has an annular collar (or a plurality of them) of greater hardness. The soft counterpart (e.g., die-cast zinc part), however, is designed such that the annular collar cuts into the softer hinge plate. This can be achieved in such a way, e.g., that the softer hinge plate is also provided with raised areas (or notches), which are preferably arranged in a radial configuration. The radial configuration of the raised areas (or notches) of the hinge plate has the advantage that the alignment washer does not have a tendency to shift into a notch, but that it merely only sinks in.

When the annular collar of the alignment washer locks into an associated annular groove that is impressed into the bottom of the cavity of the hinge plate by the annular collar, one can turn the alignment washer in any desired direction and the form-fitting engagement and form-fitting fastening between the alignment washer and hinge plate nonetheless remains intact.

This has the significant advantage that in the case of an only slightly tightened alignment washer (e.g., when loosening the screw) the form-fitting engagement with the hinge plate is always maintained and there is no danger of the entire door dropping down on the frame along with the hinge, as was the case with the other embodiments, especially with the embodiment by firm EMKA.

One therefore has, in any desired receiving bore of the hinge plate, all degrees of freedom of displacement of the alignment washer relative to the hinge plate in all directions of the plane of the hinge plate, and a completely free rotability of the alignment washer relative to the hinge plate, whereas this was not the case with the prior art of EP 0 991 836 B1.

In the EMKA design, the alignment washer always had to be rotated by hand during the adjusting process so that the fluting on the underside of the alignment washer would engage with the fluting in the region of the cavity in the hinge plate, in order to thus attain the form-fitting engagement, which resulted in a complicated, tedious, and not always form-fitting and reliable assembly, which additionally could not take place as often as desired, as the fluting could become damaged during a less than optimal assembly.

This is not required in the present invention with the annular collar, since, in the case of the invention, a form-fitting locking, e.g., of the at least one annular collar disposed on the underside of the alignment washer in the annular groove that is impressed on the bottom of the cavity by the annular collar takes place in any random rotational position of the alignment washer.

The invention is not limited to at least one annular collar being disposed on the alignment washer. The mechanical reversal shall be covered by the inventive idea as well, namely that the hinge plate has the at least one annular collar disposed on it. Also, multiple annular collars shall be possible on the alignment washer or on the hinge plate, which then cooperate with a given annular groove impressed by the annular collar on the other part. Also, combinations of the above shall be possible, so that at least one annular collar and at least one impressed annular groove exists in each case on the alignment washer and on the hinge plate. The only important point is always that the alignment washer is randomly adjustable relative to the hinge plate, and that after the assembly at least one annular collar is engaged in a form-fitting manner in a ring groove impressed by the annular collar during the assembly process.

The invention is therefore not limited to the arrangement of a single (preferably sharp-edged) annular collar on the bottom surface (face) of the alignment washer. A plurality of annular collars that have different diameters and are concentric to each other may be provided as well, each of which taken by itself is implemented sharp-edged.

The soft-mating surface comprises a plurality of radially extended rib-shaped raised areas, and the annular collar may have a triangular or semi-circular or trapezoidal profile in cross section.

The invention preferably relates to a circumferential continuous annular collar extending along the entire circumference on the face of the alignment washer. However, the invention is not limited to this. Provision may also be made for the annular collar to be arranged distributed over the circumference only in places.

Likewise, the annular collar may be replaced by punctiform or prismatic extensions, which also are arranged distributed only over an identical diameter along the circumference of the face of the alignment washer.

Earlier it was mentioned, in other respects, that there does not need to be only one single annular collar, but that a plurality of annular collars of different diameters may be provided on the face of the alignment washer.

It is of particular advantage that the entire alignment washer can now be implemented as a simple turned piece and the above-mentioned relatively sharp-edged annular collar can now be provided as a machined collar integrally formed on the alignment washer.

The alignment washer can thus be produced from a cost-effective turned steel part.

The invention will be explained in more detail below based on drawings that depict only one method of implementation. Additional features and advantages of the invention will become apparent from the drawings and from their description.

Figure 2:
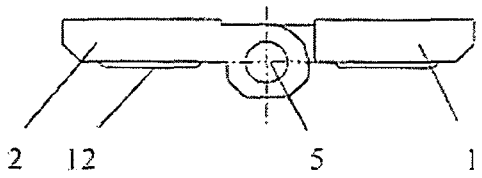
Figure 4:
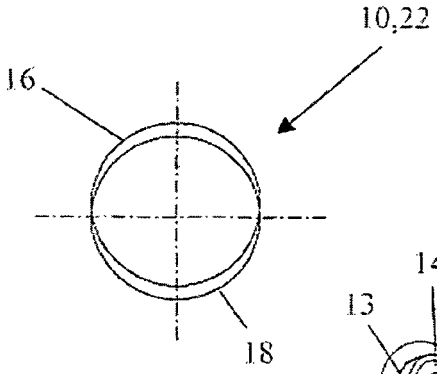
Figure 3:
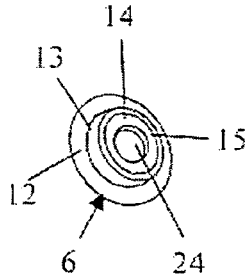
Figure 3:
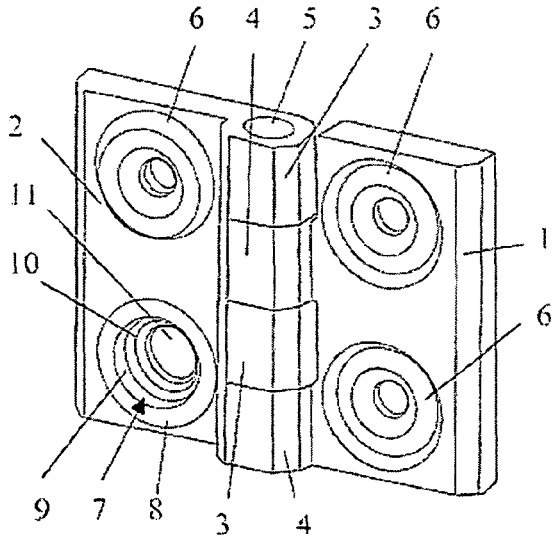
Figure 5:
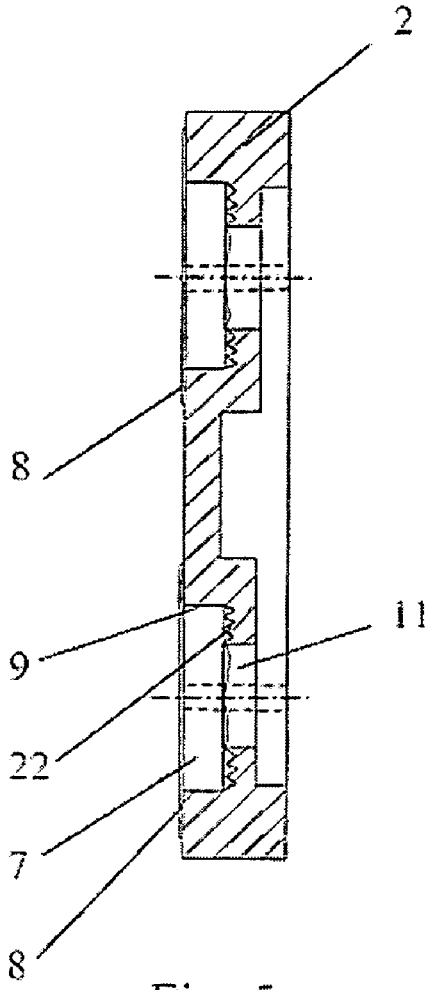
Figure 6:
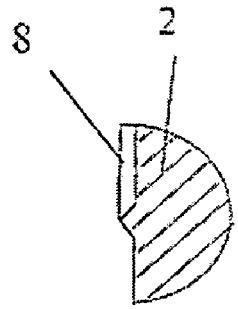
Figure 7:
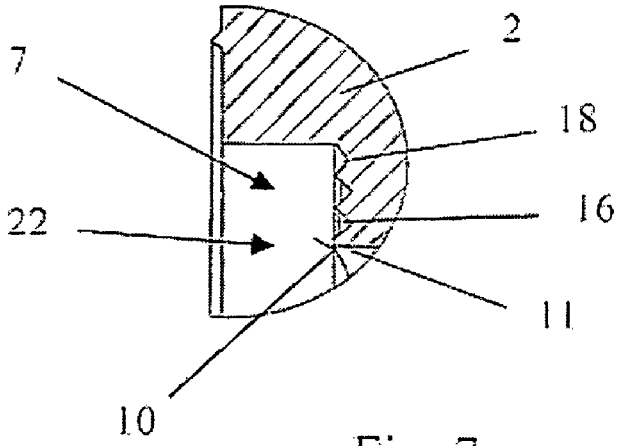
Figure 8:
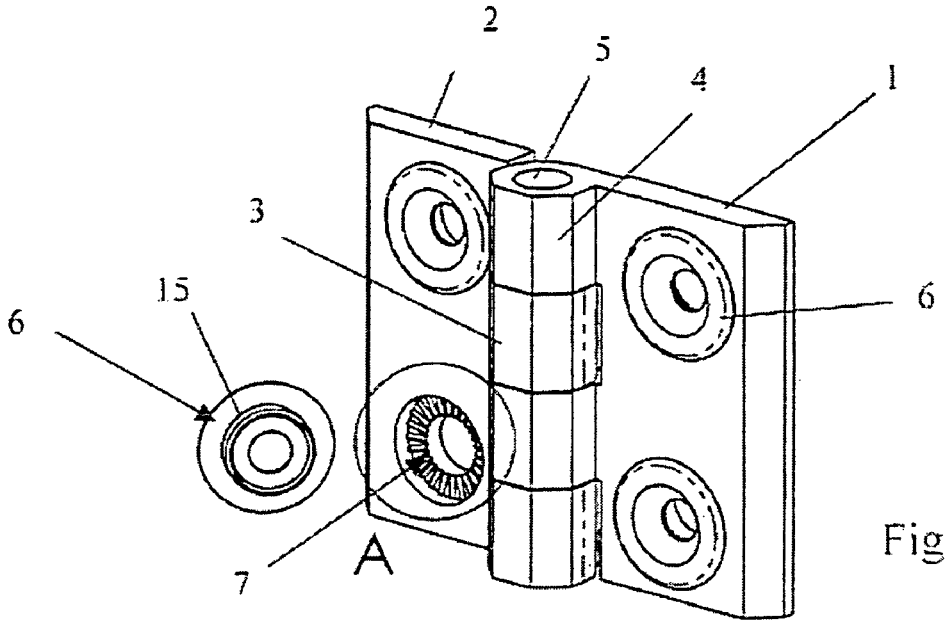
Figure 9:
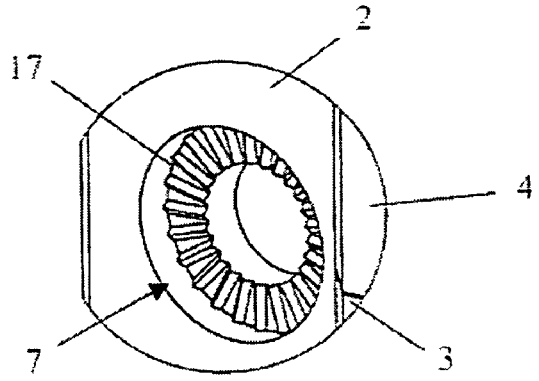
Figure 10:
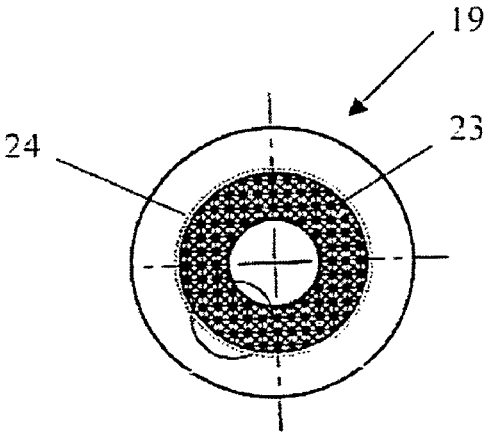
Figure 11:
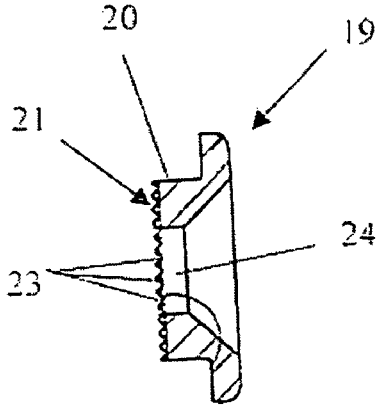

The figures show as follows:

FIG. 1: a front view of the composition of the hinge according to the invention;

FIG. 2: the top view of the illustration of FIG. 1;

FIG. 3: a partially disassembled perspective illustration of the hinge of FIG. 1 with a perspective illustration of a first embodiment of the alignment washer;

FIG. 4: in a schematic illustration, the configuration of two annular grooves at the bottom of the cavity in the hinge plate; the cavity in the hinge plate;

FIG. 5: a section through a hinge plate;

FIG. 6: an enlarged section according to FIG. 5 in the region of the circumferential edge of the receptacle in the hinge plate;

FIG. 7: an enlarged section according to FIG. 5 in the region of the fluting of the annular grooves in the receptacle in the hinge plate;

FIG. 8: a partially disassembled perspective view of the hinge according to FIG. 1 in another embodiment;

FIG. 9: an enlarged front view according to FIG. 8 of the formation of the fluting provided at the bottom in the receptacle of the hinge plate for the alignment washer;

FIG. 10: a bottom view of a second embodiment of the alignment washer;

FIG. 11: a sectional side view of FIG. 10.

In FIGS. 1, 2 and 3, the hinge is composed of two hinge plates 1, 2 that are supported pivotable toward each other, each forming extension pieces 3, 4 that are complementary to each other, having a central bore 5 extending through them, which is filled by a pin that is not shown in detail. The hinge is accordingly a single-pin hinge band.

In the region of each hinge plate 1, 2, two spaced-apart receptacles 7 are provided in this case for the corresponding adjustable accommodation of alignment washers 6.

FIG. 1 shows the alignment washers 6 already inserted into the receptacles 7.

It is apparent in this context that, regardless of the maximally possible displacement position of each alignment washer 6 in the receptacle 7, the entire receptacle 7 is covered in each case.

For identification purposes the circumference of the receptacle 7 is encompassed by an edge trim 8 of a larger dimension. FIG. 3 shows that a receptacle 7 that is recessed into the hinge plate 1 consists of the above-mentioned edge trim 8, which is implemented approximately square and which serves only for appearance purposes. It has no other function with respect to the function of the aligning device. The edge trim 8 is arranged slightly raised above the surface of the given hinge plate 1, 2. In the region of this edge trim 8, the alignment washer 6 therefore rests on a circular collar 12 of enlarged diameter. This edge trim 8 may also be eliminated, however, in another embodiment.

The diameter of the collar 12 of the alignment washer 6 is selected such that in any random displacement position, the inside diameter of the receptacle 7 is always covered.

The profile of the receptacle 7 is designed square in accordance with FIG. 5, said square having rounded edges. This is apparent from the comparison of FIG. 3, with the approximately square wall 9 depicted there, to the illustration in FIG. 5, where this wall 9 is also depicted.

The larger-diameter wall 9 transitions perpendicularly into a smaller-diameter bottom 10, wherein in the region of the bottom 10 of the receptacle 7 the fluting 22 is disposed, which is impressed by the alignment washer 6.

FIG. 6, in other respects, shows the slightly raised edge trim 8, which is implemented raised relative to the remaining surface of the hinge plate 2.

FIG. 4 shows to some extent how two annular grooves 16, 18 of equal size have been impressed in the form of the fluting 22 in the bottom surface of the bottom 10 by the alignment washer 6.

The sharp-edged annular collar 15 of the alignment washer 6, in other respects, is machined as an integral element in the region of the face 14 of a bushing 13 of a smaller diameter, said bushing 13 having a smaller diameter than, by comparison, the collar 12 encompassing the bushing 13.

FIG. 3 also shows that the hinge plates 1, 2, in their respective receptacles 7, has a central approximately circular through-opening 11 and that the alignment washer 6 has an approximately circular central through-opening 24, through which through-openings 11, 24, a mounting screw extends, which is not shown, for fastening the hinge between two elements, e.g., furniture elements, that are pivotable toward each other.

FIGS. 8 and 9 now show an embodiment of the inventive hinge that has been modified from FIG. 3, with a modified surface on the bottom 10 of the receptacle 7 (for the alignment washers 6) in the hinge plates 1, 2. The radially extending raised areas 17 shown in these Figures have a common imagined center point in the center of the receptacle 7. These radially extending raised areas 17 are shaped approximately triangular in cross section and are situated in a plane that is parallel to the plane of the hinge 2.

In another embodiment the raised areas 17 may also have a different cross-sectional shape, e.g., round, oval, square, polygonal etc. Also, the radially extending raised areas 17 do not necessarily need to have an imagined common center point, but they may also intersect in a different imagined point. The raised areas may also not intersect at all, in another embodiment, and extend parallel to each other.

Important is only that the sharp-edged annular collar 15 of the alignment washer 6 digs into the raised areas 17 in a form-fitting manner when the mounting screw (not shown) is tightened, thus leaving an impressed circular fluting 22 according to FIGS. 4 and 5.

FIGS. 10 and 11 now show an embodiment modified from FIG. 9 of the alignment washer 6 with the annular collar 15, in the form of the alignment washer 19, which, instead of the annular collar 15, has pyramid-shaped points 23 on the entire face 20 of the collar 21.

In another embodiment, however, the face 20 of the collar 21 may also be provided with the pyramid-shaped points 21 only in sections, which pyramid-shaped points 21 may also be arranged in the form of a ring or multiple rings.

In this case too, it is important only that the pyramid-shaped points 23 of the alignment washer 6 dig into the surface of the bottom 10 of the receptacle 7 of the hinge plates 1, 2 in a form-fitting manner when the mounting screw (not shown) is tightened, thereby leaving impressed flutings (not shown).

Of course, a combination of the embodiments of FIGS. 8/9 and 10/11 may be used as well, such that the alignment washer 19 is inserted into the receptacle 7 of FIGS. 8/9 and the pyramids form-fittingly dig into the radially extending raised areas 17 when the mounting screw (not shown) is tightened.

DRAWING LEGEND

1 hinge plate
2 hinge plate
3 extension piece
4 extension piece
5 bore
6 alignment washer
7 receptacle
8 circumferential edge
9 wall
10 bottom
11 through-opening in 7 of 1, 2
12 collar
13 bushing
14 face
15 annular collar (alignment washer)
16 annular groove
17 radially extending raised areas
18 annular groove
19 alignment washer
20 collar of 19
21 face of 20
22 fluting

23 pyramid-shaped points

24 through-opening in 6 and 19

What is claimed is:

1. An adjustable hinge, comprising:

at least one pivotable hinge plate (1, 2) pivotably hinged to a coupling element, the pivotable hinge plate (1,2) including at least one through-opening (11), and at least one alignment washer (6) adjustably connected to said hinge plate (1, 2) and provided with at least one through-opening (24) corresponding to the at least one through-opening (11) of the hinge plate (1, 2), wherein the through-openings (11) of the hinge plate (1, 2) and the at least one through-opening (24) of the at least one alignment washer (6) are configured to allow penetration by mounting means for mounting the hinge to other structures, wherein the alignment washer (6) and the hinge plate (1, 2) are adjustable relative to each other in a plane of the hinge plate (1, 2), wherein one of the alignment washer (6) and the hinge plate (1, 2) is provided with at least one sharp-edged raised area (15, 23), wherein the at least one sharp-edge raised area (15, 23) has a higher degree of hardness than at least a mating surface of the other of the alignment washer (6) and the hinge plate (1, 2) that is in contact with at least one sharp-edged raised area (15, 23), and wherein the at least one sharp-edged raised area (15, 23) has a triangular or semi-circular or trapezoidal profile in axial cross section, and the at least one sharp-edged raised area (15, 23) is in the shape of at least one annular collar (15), which protrudes from the one of the alignment washer (6) and the hinge plate (1, 2), and which is circular or elliptical.

2. An adjustable hinge according to claim 1, wherein the at least one annular collar (15) penetrates into a soft mating surface of the hinge plate (1, 2) in a form-fitting manner and has at least one raised area (17) or at least one recess extending from or into, respectively, a surface of the mating surface.

3. An adjustable hinge according to claim 2, characterized wherein the soft-mating surface comprises a plurality of radially extended rib-shaped raised areas (17).

4. An adjustable hinge according to claim 1, wherein the at least one protruding annular collar (15) is disposed on the at least one alignment washer (6).

5. An adjustable hinge according to claim 4, wherein the at least one annular collar (15) protrudes on the at least one alignment washer (6) axially on the face.

6. An adjustable hinge according to claim 1, wherein the at least one annular collar (15) has a closed circular shape or formed by a plurality of identical or similar pointed raised areas, which together form a regularly or irregularly interrupted ring.

7. An adjustable hinge according to claim 1, wherein the at least one annular collar (15) is configured in a form of punctiform, or prismatic prolongations, or indentations.

8. An adjustable hinge according to claim 1, wherein the at least one annular collar is a plurality of annular collars (15) of different diameters are provided that are concentric to each other.

9. An adjustable hinge according to claim 1, wherein the alignment washer (6) is axially symmetric and the at least one annular collar (15) is integrally machined on the alignment washer (6) as a collar.

10. An adjustable hinge according to claim 1, wherein the alignment washer (6) has a collar (12) of larger dimension on a face thereof, situated on an opposite side to the annular collar (15) or matrix surface or rib surface (15, 23).

11. An adjustable hinge according to claim 1, wherein the alignment washer (6) is formed of a relatively harder material and the hinge plate (1, 2) is formed of a relatively softer material.

12. An adjustable hinge according to claim 11, wherein the alignment washer (6) is formed of steel and the hinge plate (1, 2) is formed of die-cast zinc.

13. An adjustable hinge according to claim 1, wherein the at least one sharp-edged raised area is one single sharp-edged area, the at least one annular collar is one single annular collar (15), and the single annular collar (15) penetrates into a soft mating surface of the hinge plate (1, 2) in a form-fitting manner and has at least one raised area (17) or at least one recess extending from or into, respectively, a surface of the mating surface.

14. An adjustable hinge according to claim 1, wherein the at least one sharp-edged raised area is one single sharp-edged area, the at least one annular collar is one single annular collar (15).

15. An adjustable hinge, comprising:

at least one pivotable hinge plate (1, 2) pivotably hinged to a coupling element, the pivotable hinge plate (1,2) including at least one through-opening (11), and at least one alignment washer (6) adjustably connected to said hinge plate (1, 2) and provided with at least one through-opening (24) corresponding to the at least one through-opening (11) of the hinge plate (1, 2), wherein the through-openings (11) of the hinge plate (1, 2) and the at least one through-opening (24) of the at least one alignment washer (6) are configured to allow penetration by mounting means for mounting the hinge to other structures, wherein the alignment washer (6) and the hinge plate (1, 2) are adjustable relative to each other in a plane of the hinge plate (1, 2), wherein one of the alignment washer (6) and the hinge plate (1, 2) is provided with at least one sharp-edged raised area (15, 23), wherein the at least one sharp-edge raised area (15, 23) has a higher degree of hardness than at least a mating surface of the other of the alignment washer (6) and the hinge plate (1, 2) that is in contact with at least one sharp-edged raised area (15, 23), and wherein the at least one sharp-edged raised area is designed as a matrix surface having a plurality of pyramid-shaped points (23).

16. An adjustable hinge according to claim 15, wherein a soft mating surface of the plate (1, 2) into which the points (23) penetrates in a form-fitting manner has at least one raised area (17) or at least one recess from the surface of the mating surface.

* * * * *